US005351353A

United States Patent [19]

Walters

[11] Patent Number: 5,351,353

[45] Date of Patent: Oct. 4, 1994

[54] BRIDGE OR TUNNEL CONSTRUCTION

[75] Inventor: Darryl F. Walters, Brisbane, Australia

[73] Assignee: CSR Humes Pty. Limited, North Sydney, Australia

[21] Appl. No.: 861,257

[22] Filed: Mar. 31, 1992

[30] Foreign Application Priority Data

Apr. 2, 1991 [AU] Australia ..... PK5359

[51] Int. Cl.[5] ..... E01D 7/00; E04B 1/32; E21D 9/00

[52] U.S. Cl. ..... 14/24; 52/86; 405/132

[58] Field of Search ..... 14/24–26; 52/86, 89, 223 R, 227–230; 47/44; 405/132, 134–135, 150.1, 150.2

[56] References Cited

U.S. PATENT DOCUMENTS

| | | | |
|---|---|---|---|
| 1,356,025 | 10/1920 | Thomas | 14/25 |
| 4,065,906 | 1/1978 | Mears | 52/86 X |
| 4,587,684 | 5/1986 | Miller | 52/87 X |
| 4,785,605 | 11/1988 | Jenn | 52/89 X |
| 5,159,790 | 11/1992 | Harding | 52/86 |
| 5,159,792 | 11/1992 | Pomento | 52/86 X |

FOREIGN PATENT DOCUMENTS

| | | | |
|---|---|---|---|
| 4040899 | 7/1990 | Japan | 14/26 |
| 0293951 | 7/1928 | United Kingdom . | |
| 0945258 | 12/1963 | United Kingdom . | |
| 1348131 | 3/1974 | United Kingdom . | |
| 1398389 | 6/1975 | United Kingdom . | |
| 1548208 | 7/1979 | United Kingdom . | |

*Primary Examiner*—Kenneth J. Dorner
*Assistant Examiner*—Nancy P. Connoly
*Attorney, Agent, or Firm*—Robert F. O'Connell; Kevin J. Fournier

[57] ABSTRACT

A bridge or tunnel construction consisting of one or more arch units (10), each unit formed from a pair of reinforced concrete arch segments (11 and 12) interconnected to form the crown of the arch unit with the arch unit or units being overlaid with a compacted interacting soil layer.

4 Claims, 2 Drawing Sheets

BRIDGE OR TUNNEL CONSTRUCTION

This invention relates to bridge or tunnel construction, and more particularly the construction of such using prefabricated (precast) concrete components, utilising soil-structure interaction to develop stability and strength.

One of the most commonly used techniques for constructing bridges or tunnels, involves the construction on site of footings and supporting walls spaced apart to define the span of the bridge or tunnel, and thereafter casting of a road or tunnel roof slab between the walls, and over which a road, railway or the like is provided, or beneath which a tunnel extends.

Another commonly used technique involves constructing on site arch type bridges or tunnels which have the ability to support vertical loads, and over which a road, railway or the like is constructed, or beneath which a tunnel extends.

Both the above techniques are time, labour and cost intensive, and with recent demand to reduce these factors in the construction of bridges and tunnels, techniques have evolved which utilise prefabricated, and in the case of concrete, precast units, which can be manufactured off-site, and thereafter brought to the construction site, and assembled to form the bridge or tunnel.

One such technique involves prefabricated units in the form of prefabricated arch units, such as reinforced concrete arch units, a plurality of which units are placed side by side to form a bridge or tunnel completed by other units such as spandrel walls defining the sides of the bridge, or the ends of the tunnel, and associated wing walls. However, such techniques, which involve unitary arch units spanning the full width required are limited, due to weight, strength, handling and transport requirements, to spans of up to twelve meters.

There is a demand to construct bridges or tunnels having spans in excess of twelve meters, and possibly up to thirty meters where, due to weight, strength, handling and transportation requirements, unitary arch units are impossible or not practical.

It is therefor an object of the present invention to provide a bridge or tunnel construction involving arch units formed from a plurality of concrete arch segments interconnected on site to form an arch unit having a span of greater length than has been possible with unitary arch units.

The invention therefor envisages, a bridge or tunnel construction, including at least one arch unit formed from a plurality of reinforced concrete arch segments interconnected to form said arch unit.

Preferably a pair of interconnected said arch segments have opposing cavities formed in the ends thereof, through which at least one tie bar or cable extends and connected to each segment to interconnect said segments.

One preferred embodiment of the invention will now be described with reference to the accompanying drawings, in which.

Figure 1:
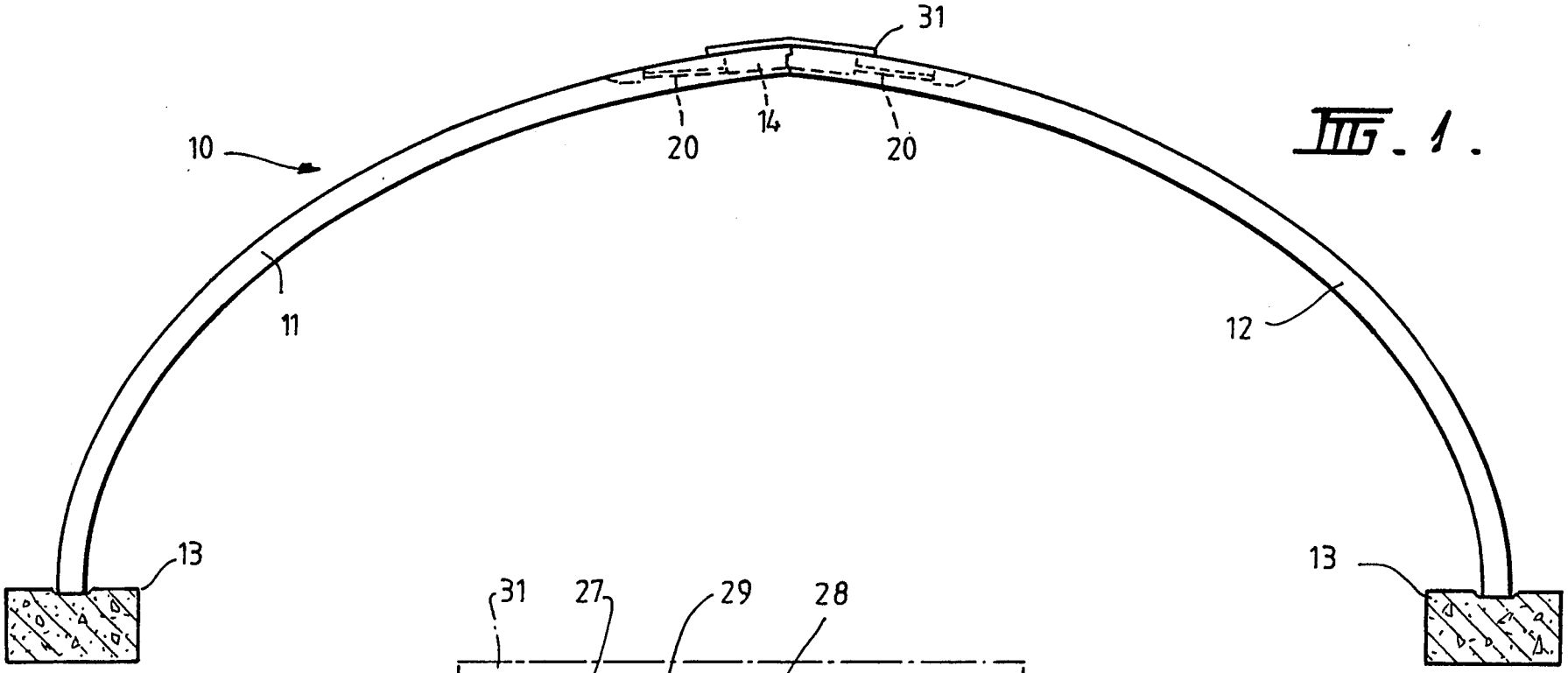
FIG. 1 is an end elevational view of a pair of arch segments forming an arch unit beneath which a tunnel is formed or over which a bridge provided.

Referring to FIG. 1 of the drawings, the arch unit generally indicated as 10 is formed from a pair of precast and reinforced concrete arch segments 11 and 12 which when interconnected on-site form a continuous arch beneath which a tunnel is provided, or over which a road, railway or the like is formed by an embankment and allowing soil-structure interaction. The lower extreme ends of each arch segment is supported on previously cast concrete footings 13 and the arch segments 11 and 12 are interconnected to form the crown of the arch unit.

Figure 4:
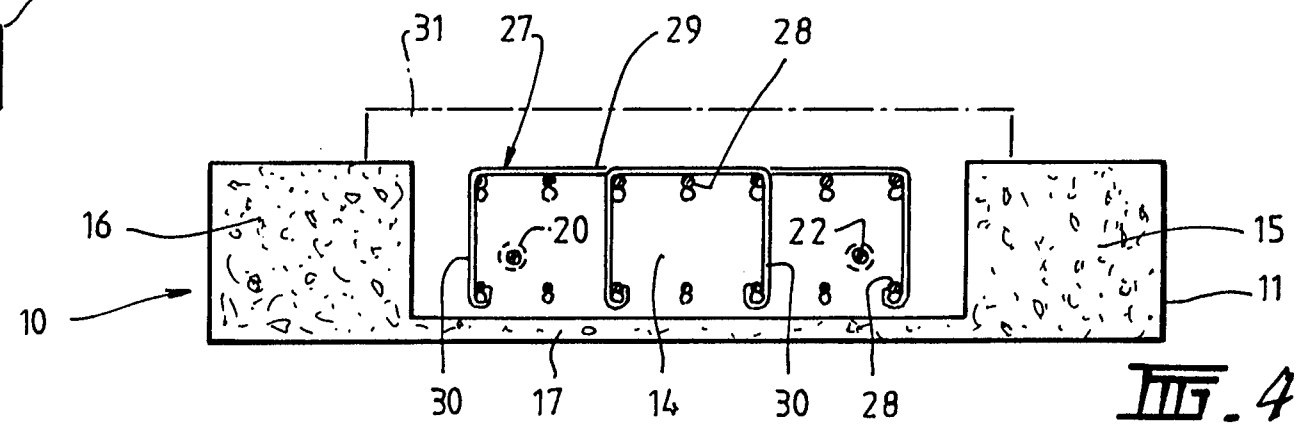
FIG. 4 is a cross-sectional view taken along line B—B of FIG. 2.
Figure 3:
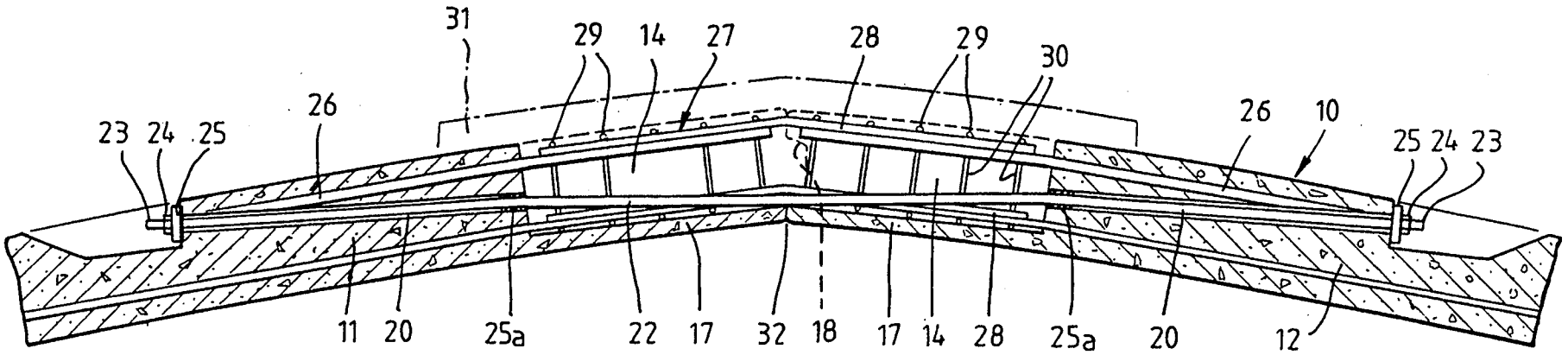
FIG. 3 is a cross-sectional view taken along line A—A of FIG. 2.
Figure 2:
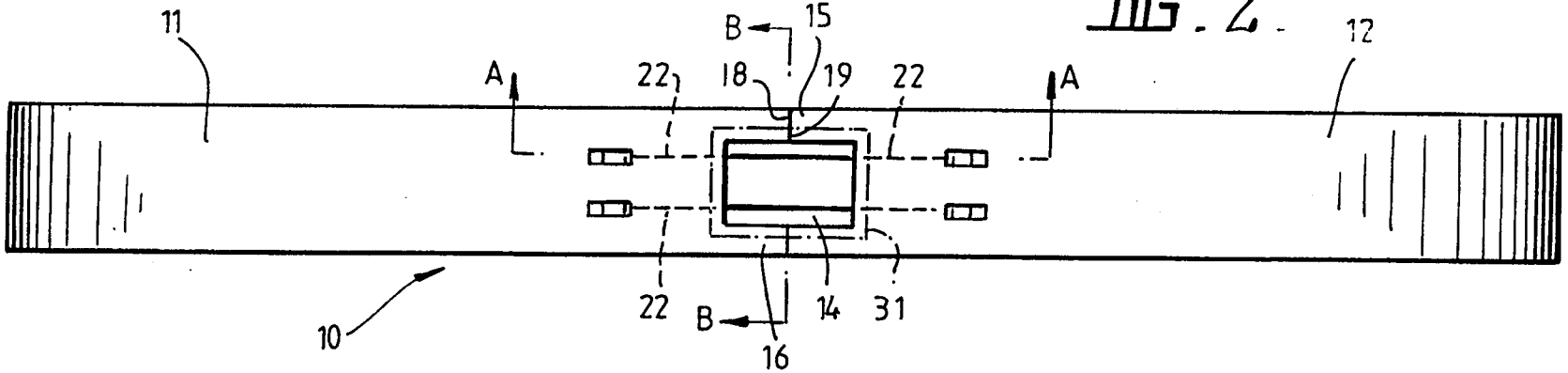
FIG. 2 is a plan view of the arch unit of FIG. 1.

With reference to FIGS. 2 to 4, the upper extreme ends of the arch segments, which are to be interconnected, have cavities 14 formed by sidewalls 15 and 16, base walls 17 and keyed end walls 18 and 19. Passageways 20 are formed through the arch segments 11 and 12 to communicate with their respective cavities 14 and, in this embodiment, a pair of steel tie bars or wire ropes 22 are positioned so as to extend through the passageways 20 and associated cavities 14. At either ends the tie bars are threaded, or in the case of this embodiment the cables 22 have threaded extensions 23 swagged thereto, which co-operate with bolts 24 and intervening washers 25, and the wire rope cables serve to interconnect the upper extreme ends of the arch segments together. Bushes **25*a* are inserted into the passageways 20 around the cables 22 and serve to seal the ends of passageways 20 at the cavities 14. Metal lap bars 26 of the reinforcement of each arch segment extend into their associated cavity 14 and may be attached, for example, by welding to a steel reinforcement cage 27**.

The cage 27 comprises longitudinally extending members or splice bars 28 which extend over the crown of the arch unit 10, and lateral members 29 with radial extending ties 30 linking the splice bars 28 together.

The interconnection between the upper remote ends of the arch segments 11 and 12 is completed by filling the opposed cavities 14 with a concrete mix to form a crown cap 31. In order to assist in adherence between the cap 31 and the cavities 14 the surfaces of the cavities, and the adjacent outer surfaces of the arch segments, may be toughened, and the space 32 between the abutting ends of the base walls 17 of the cavities may be filled with mastic joint seal pads.

The bridge or tunnel may comprise only one arch unit 10, or in usual constructions a plurality of arch units 10 may be provided, with associated spandrel walls and wing walls, and completed by an overlaid compacted interacting soil layer to provide a construction with a soil-structure interaction.

A major feature of the invention is it that provides the ability to construct a bridge or tunnel without scaffolding or support. This feature is achieved by the keyed end walls 18 and 19 and the steel tie bars or wire ropes 22.

The claims defining the invention are as follows:

1. A bridge or tunnel construction, including at least one arch unit formed from a plurality of reinforced concrete arch segments interconnected to form said arch unit, the ends of the arch segments at the interconnections therebetween having cavities formed therein, the cavity in the end of one segment opposing the cavity in the end of the other, said cavities facing each other in the direction of the arch and through which cavities at least one tie member extends and is connected to each said segment to provide the interconnection, and wherein said arch unit is overlaid with a compacted interacting soil layer to complete the bridge or tunnel construction.

2. A bridge or tunnel construction, including at least one arch unit formed from a plurality of reinforced concrete arch segments interconnected to form said arch unit, the ends of the arch segments at the interconnections therebetween having cavities formed therein, the cavity in the end of one segment opposing the cavity in the end of the other, said cavities facing each other in the direction of the arch and through which cavities at least one tie member extends and is connected to each said segment to provide the interconnection, and wherein each segment contains reinforcement and part of the reinforcemnt in each segment extends into its respective cavity.

3. A bridge or tunnel construction as claimed in claim 1 or 2, wherein a plurality of said arch units are placed laterally side by side to form said bridge or tunnel construction.

4. A bridge or tunnel construction as claimed in claim 1 or 2, wherein a cage of reinforcing members is provided in said opposed cavities and the interconnections are completed by a concrete mix to form a crown for the arch unit.

* * * * *